United States Patent [19]

Buljan et al.

[11] Patent Number: 4,696,352

[45] Date of Patent: Sep. 29, 1987

[54] INSERT FOR A DRILLING TOOL BIT AND A METHOD OF DRILLING THEREWITH

[75] Inventors: Sergej-Tomislav Buljan, Acton; J. Gary Baldoni, Walpole, both of Mass.

[73] Assignee: GTE Laboratories Incorporated, Waltham, Mass.

[21] Appl. No.: 840,309

[22] Filed: Mar. 17, 1986

[51] Int. Cl.[4] ..... E21B 10/46

[52] U.S. Cl. ..... 175/57; 175/410; 428/552

[58] Field of Search ..... 175/57, 410, 409; 428/548, 552

[56] References Cited

U.S. PATENT DOCUMENTS

| | | | |
|---|---|---|---|
| Re. 32,093 | 3/1986 | Hale | 428/336 |
| Re. 32,111 | 4/1986 | Lambert et al. | 428/212 |
| 3,836,392 | 9/1974 | Lux et al. | 117/169 R |
| 3,837,896 | 9/1974 | Lindstrom et al. | 117/70 A |
| 3,854,991 | 12/1974 | Hale | 117/169 R |
| 3,874,900 | 4/1975 | Post et al. | 117/69 |
| 3,914,473 | 10/1975 | Hale | 427/255 |
| 3,955,038 | 5/1976 | Lindstrom et al. | 428/457 |
| 3,967,035 | 6/1976 | Hale | 428/336 |
| 4,018,631 | 4/1977 | Hale | 148/31.5 |
| 4,035,541 | 7/1977 | Smith et al. | 428/217 |
| 4,101,703 | 7/1978 | Schintlmeister | 428/216 |
| 4,150,195 | 4/1979 | Tobioka et al. | 428/548 |
| 4,268,582 | 5/1981 | Hale et al. | 428/446 |
| 4,343,865 | 8/1982 | Graham | 428/552 |
| 4,400,224 | 8/1983 | Arai et al. | 148/15 |
| 4,450,205 | 5/1984 | Itaba et al. | 428/552 |
| 4,474,849 | 10/1984 | Fujimori et al. | 428/332 |
| 4,489,796 | 12/1984 | Sanchez et al. | 175/410 |
| 4,498,549 | 2/1985 | Jürgens | 175/329 |

OTHER PUBLICATIONS

Perrot, Colin M., "Tool Materials for Drilling and Mining," *Ann. Rev. Mater. Sci.*, 9; 27 (1979).

*Primary Examiner*—Stephen J. Novosad
*Assistant Examiner*—Thuy M. Bui
*Attorney, Agent, or Firm*—Frances P. Craig

[57] ABSTRACT

A coated insert for such drilling tool bits as mine tool roof bits or masonry drill bits. A hard, fracture resistant substrate is coated with one or more thin adherent layers of refractory coating material. The material of each layer is a carbide, nitride, or carbonitride of titanium, hafnium, vanadium, tantalum, or niobium, or an oxide of aluminum or zirconium or a mixture or solid solution of these compounds. Methods for drilling holes in a mine roof or other hard materials are also disclosed.

22 Claims, 7 Drawing Figures

INSERT FOR A DRILLING TOOL BIT AND A METHOD OF DRILLING THEREWITH

FIELD OF THE INVENTION

This invention relates to tool inserts. More particularly, it is concerned with coated inserts for drilling tool bits such as mine tool roof bits, masonry bits and the like.

BACKGROUND OF THE INVENTION

The roofs of coal mine shafts require support during a mining operation. This support is provided by roof bolts which are anchored into the rock strata found above the coal seam. In order to attach the roof bolts to the roof of a coal mine, many holes must be drilled into the rock strata and must be spaced closely enough to provide a strong, safe roof in the mine.

In the manufacture of prior art roof drilling tools, it has been the practice to make the drill body of a material such as steel and to mount an abrasion-resistant insert at the cutting end. The insert is formed of a hard material and is usually anchored in place in the body of the drill by soldering or brazing it in place.

Likewise, masonry drills have been known and are commonly used for drilling holes in especially hard, friable material such as masonry or stone. These drills are usually comprised of an elongated body or shank having a spiral groove or grooves formed along its length and having a diametrically extending straight groove on its leading end. A hard insert is set into the straight groove and is held in place by soldering or brazing.

The inserts described above usually have sharp cutting edges on the leading end so that the drills might be effectively used in the coal, hard masonry or stone material. The inserts must be capable of resisting wear, fracture, and the abrasive action of the chips from the material being drilled. Cemented carbides such as cobalt bonded tungsten carbide are at present the most commonly used materials for such drill bit inserts.

The speed with which holes can be drilled, the maintenance of this penetration rate and the wear resistance of the tools are important factors in such operations. Therefore, improvement in any of these factors is desirable, and has to some degree been achieved by changing the composition of the cemented carbide material, such as by adjusting the carbide to binder ratio, by selecting from various binder metals (e.g. Co or Ni-Fe), by adjusting the carbide grain size or by changing the insert geometry.

The coating of cemented carbide cutting tool inserts for metal removal applications with oxides, carbides, nitrides, and carbonitrides is known. However, prior to the present invention it has been widely accepted in the art that little or no improvement in performance could be expected for such coated drill bit inserts for mining or masonry applications. Conversely, it has been taught that such coating is contraindicated in mining applications (Colin M. Perrot, *Ann. Rev. Mater. Sci.* 9, 23 (1979) at p. 27). Although some coatings have been tried, for example boride coatings, the aluminum oxides, and the transition metal carbides, nitrides and carbonitrides have been considered not sufficiently hard for thin coatings on inserts for drilling in hard materials such as rock, coal and the like. (See for example U.S. Pat. No. 4,268,582 to Hale et al., column 1, lines 25 to 31.)

Thick polycrystalline layers of diamond or cubic boron nitride are commonly applied to tool bits for such uses as deep well drilling to provide the required wear resistance, but the thin wear resistant coatings described above have, again, not been considered sufficiently hard for such purposes.

U.S. Pat. Nos. 4,268,582, referenced above, and 4,343,865 disclose cemented carbide compacts for use in tools used for machining, rock drilling, and coal cutting, each having a boride coating such as titanium boride, hafnium boride, zirconium boride or tantalum boride. In the U.S. Pat. No. 4,268,582 patent, in interlayer of one or more layers of carbides, nitrides, or carbonitrides of groups IV B and V B elements provides improved bonding of the boride coating, but the increased wear resistance is provided by the outer boride coating. Similarly, in the U.S. Pat. No. 4,343,865 patent, a thin (about 1 micron) intermediate layer of a carbide, nitride, or carbonitride of a group IVB element, or a mixture thereof, prevents diffusion of elemental boron from a bonding layer underlying the boride coating into the substrate. In both of these patents, the boride outer layer is considered necessary to increase the wear resistance.

SUMMARY OF THE INVENTION

In accordance with one aspect of the invention is provided a new and improved method of drilling a hole in a hard material such as rock, coal, masonry, concrete, and the like, for example drilling a hole in a mine roof. The method involves positioning a drilling tool having a drilling tool bit insert comprising a shaped substrate formed of a hard, fracture resistant material and coated with one or more thin adherent layers of refractory coating material. The material of each layer comprises a composition selected from the group consisting of carbides, nitrides, and carbonitrides of titanium, hafnium, vanadium, tantalum, and niobium, and oxides of aluminum and zirconium, and mixtures and solid solutions of these compounds. The drilling tool bit insert is rotated at a sufficient rate and sufficient thrust is applied to the drilling tool bit insert to drill the hole in the hard material. In the preferred method for drilling a hole in concrete, masonry, or the like, the rate of rotation is about 100 to about 1700 rpm, the thrust, about 100 to about 5000 lbs. In the preferred method for drilling a hole in a mine roof, the rotation rate is between about 100 to about 1700 rpm, the thrust, between about 500 and about 8000 lbs.

According to other aspects of the invention are provided a mine tool roof bit insert and a masonry drill bit insert each comprising a shaped substrate formed of a hard, fracture resistant material and having one or more cutting edges, and one or more thin adherent layers of refractory coating material deposited on the substrate at least at and adjacent to the cutting edges. The material of each layer comprises a composition selected from the group consisting of carbides, nitrides, and carbonitrides of titanium, hafnium, vanadium, tantalum, and niobium, and oxides of aluminum and zirconium, and mixtures and solid solutions of these compounds.

In the preferred inserts according to the invention, the substrate is a tungsten carbide composition containing about 6 w/o cobalt, is coated with an inner layer of titanium carbide and an outer layer of titanium nitride or $Al_2O_3$, the total thickness of the layers being about 5–20 microns. The especially preferred inserts have a geometry including rounded corners between the top and end surfaces.

BRIEF DESCRIPTION OF THE DRAWINGS

The present invention may be better understood by referring to the following detailed description taken in connection with the drawings in which.

DETAILED DESCRIPTION OF THE PREFERRED EMBODIMENTS

Figure 1:
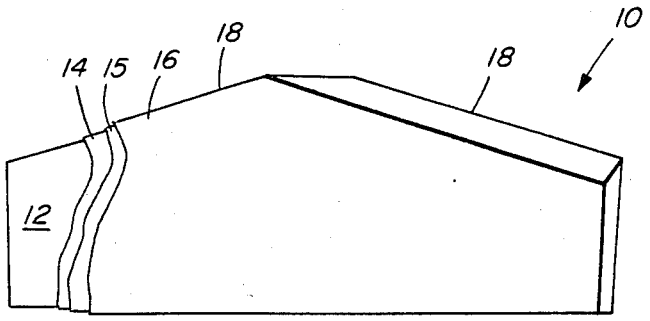
FIG. 1 is a front view of an insert according to the invention partly cut away to show a substrate, an inner layer, an intermediate layer and an outer layer.

Referring first to FIG. 1, there is shown a drill bit insert 10 comprising shaped substrate 12 of a hard, fracture resistant material such as tool steels, cemented carbides and the like. Substrate 12 may comprise for example a composite material, the components of which may be uniformly distributed throughout the substrate or, alternatively, the ratio of the components may vary from one region to another within the substrate, such as from the substrate surface to its core. A preferred material for the substrate is a cemented tungsten carbide containing about 5 to 15 w/o (weight percent) cobalt as a binder and optionally with other refractory materials such as cubic refractory transition metal carbides as additives. The grain size of the substrate tungsten carbide may vary from fine (e.g. about 1 micron), providing a harder insert, to coarse (e.g. about 12 microns), providing a tougher insert, depending on the intended use, the carbide to binder ratio and the degree of fracture toughness desired.

Substrate 12 is coated with one or more thin adherent layers of refractory coating material, illustrated in FIG. 1 as inner layer 14, intermediate layer 15 and outer layer 16. The material of each layer is independently selected from the carbides, nitrides, or carbonitrides of titanium, hafnium, vanadium, tantalum, or niobium, or the oxides of aluminum or zirconium, or mixtures or solid solutions of these compounds. Each layer may be deposited on the substrate, for example, by chemical or physical vapor deposition techniques known in the art, such as those described in U.S. Pat. No. 4,441,894 at column 5, line 35 to column 7, line 17, incorporated herein by reference. Alternatively, one or more of the layers between the substrate and the outermost layer may be a transition layer formed by a reaction between the substrate and a deposited layer or between two deposited layers. For example, inner layer 14 may be titanium carbide, outer layer 16 may be titanium nitride, and intermediate layer 15 may be a titanium carbonitride transition layer formed by a reaction between inner layer 14 and outer layer 16. The thickness of each layer is preferably about 0.5 to 20 microns. More preferred is an insert in which the total thickness of the layers is about 5 to 10 microns.

Inserts as described above may be mounted as drill bit cutter blades in such tools as mine tools and masonry drills, for increasing tool life by improving wear resistance and for improving maintenance of the penetration rate, when drilling holes in such hard materials as masonry, rock, coal, concrete and the like. In operation, such drilling tools having inserts according to the invention are positioned to begin drilling the hole, the insert is rotated at a sufficient rate and sufficient thrust is applied to the insert to drill the hole. For drilling a hole in a mine roof, a rotation rate of between 100 rpm and about 1700 rpm, and a thrust of between about 500 lbs and about 8000 lbs are preferred. For drilling a hole in concrete, masonry, or the like, a rotation rate of about 100 to about 1700 rpm, and a thrust of about 100 to about 5000 lbs is preferred.

An especially advantageous insert, in particular a mine tool roof insert, is provided by applying one or more adherent layers of refractory material as described above to a substrate having a geometry as disclosed in U.S. Pat. No. 4,489,796 to Sanchez et al., incorporated herein by reference. Such a radiused insert is illustrated in FIG. 2 as insert 20 comprising shaped substrate 22 of a hard, fracture resistant material, preferably the same materials as those described above for insert 10.

Figure 2:
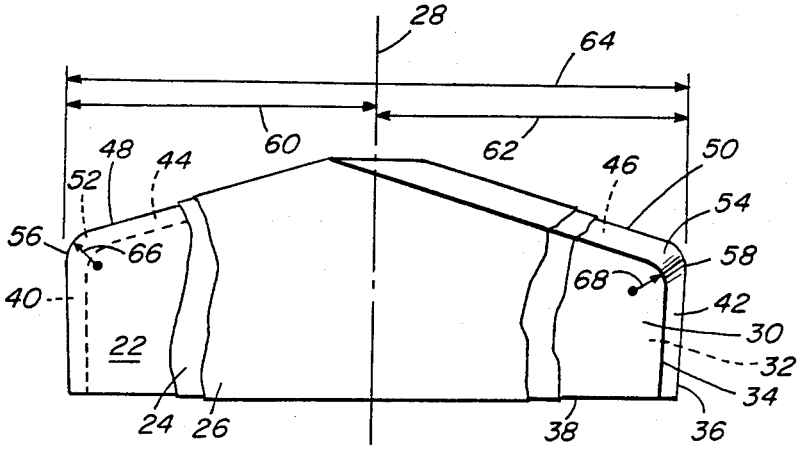
FIG. 2 is a front view of a preferred radiused mine tool roof bit insert according to the invention partly cut away to show a substrate, an inner layer and an outer layer.

Substrate 22 is coated with one or more thin adherent layers of refractory coating material, illustrated in FIG. 2 as inner layer 24 and outer layer 26. The material of each layer is independently selected from the carbides, nitrides, or carbonitrides of titanium, hafnium, vanadium, tantalum, or niobium, or oxides of aluminum or zirconium, or mixtures or solid solutions of these compounds. The layers may be deposited or formed as described above for insert 10. The preferred thicknesses of the layers are the same as those described above for insert 10.

As described in U.S. Pat. No. 4,489,796, substrate 20 comprises a flat elongated member generally symmetrical about central axis 28. Substrate 20 has two generally planar side surfaces 30 and 32 extending substantially parallel to central axis 28. The perimeters 34 and 36 of side surfaces 30 and 32 are interconnected by surfaces including bottom surface 38, end surfaces 40 and 42 and top surfaces 44 and 46. Top surface 44 joins side surface 30 and top surface 46 joins side surface 32 to form cutting edges 48 and 50 respectively.

Top surface 44 joins end surface 40 and top surface 46 joins end surface 42 to define rounded corners 52 and 54 respectively. Each rounded corner 52, 54 has a point, 56 and 58 respectively, located thereon, points 56 and 58 each being located a maximum distance, indicated by double pointed arrows 60 and 62 respectively, from central axis 28, measured along a line perpendicular to central axis 28; that is, the maximum distances are the largest radial dimensions of substrate 20. The maximum distances shown by arrows 60 and 62 added together define a maximum (or gauge) diameter, indicated by double pointed arrow 64, which is the diameter of a circle circumscribed when substrate 20 is rotated about central axis 28. Rounded corners 52 and 54 each have a radius of curvature, indicated by arrows 66 and 68 respectively, which is from about $D/(32\times1.375)$ inches to about $3D/(32\times1.375)$ inches, where D is the maximum diameter; that is, each radius of curvature is about 0.023 and 0.068 times the maximum diameter shown by arrow 64.

Inserts 10 and 20 are each coated with one or more thin adherent layers of refractory coating material, as described above, at least at and adjacent to the cutting edges, shown as 18 in FIG. 1 and as 48 and 50 in FIG. 2, and may each be coated over the entire surface of substrates 12 and 22. For some uses, however, it may be desireable to leave portions of the substrate uncoated. For example, the portion to be brazed may be left uncoated in order to more easily anchor the insert in place on the tool. The portion of the substrate to be left uncoated may be protected during chemical or physical vapor deposition , for example by masking this portion using a graphite, refractory metal, or ceramic mask.

The following Examples are presented to enable those skilled in this art to more clearly understand and practice the present invention. These examples should not be considered as a limitation upon the scope of the present invention, but merely as being illustrative and representative thereof.

EXAMPLE 1

Effect of TiC/TiN Coating on Wear Resistance of Inserts

Figure 3:
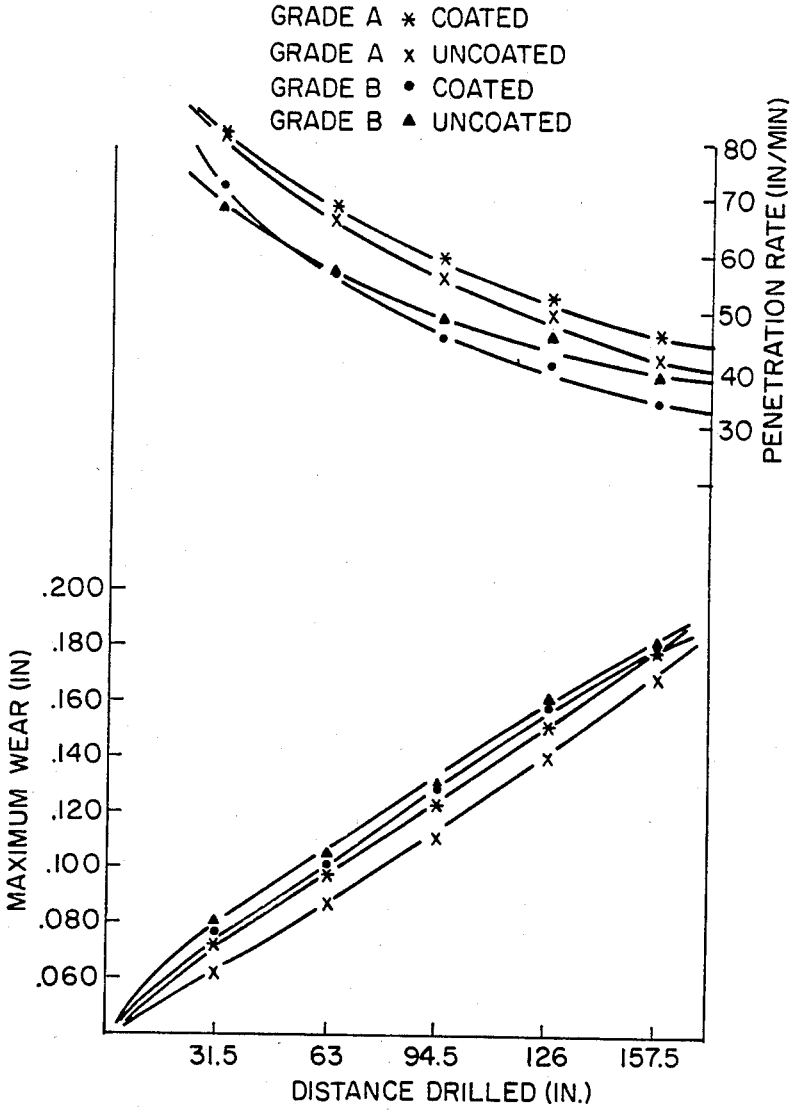
FIG. 3 is a graph illustrating the improvement in wear resistance and maintenance of penetration rate described in Example 1.

Holes 32 inches in depth were drilled in sandstone using both coated and uncoated inserts mounted as the drill bit cutter blades on a drilling tool. Samples of two different substrates were tested, insert A and insert B, each being a tungsten carbide mine tool roof bit insert containing about 6 w/o cobalt as a binder. Insert A is the harder of the two, with a fine grain structure; insert B is the tougher, with a coarse grain structure. The coated samples comprised insert substrates A and B coated with an adherent inner layer of titanium carbide about 3 microns thick and an adherent outer layer of titanium nitride about 3 microns thick, each layer being deposited by chemical vapor deposition, as described above. The drilling speed was maintained at 500 rpm; the thrust at 3000 lbs. As illustrated in FIG. 3, the coating improved the wear resistance of the samples of insert A, with good maintenance of the penetration rate. However, the effect of the coating on the samples of less hard insert B was marginal, which effect is attributable to the characteristics of the substrate at the high speed.

EXAMPLE 2

Wear Resistance of TiC/TiN Coated Inserts at Slower Drilling Speed

Figure 4:
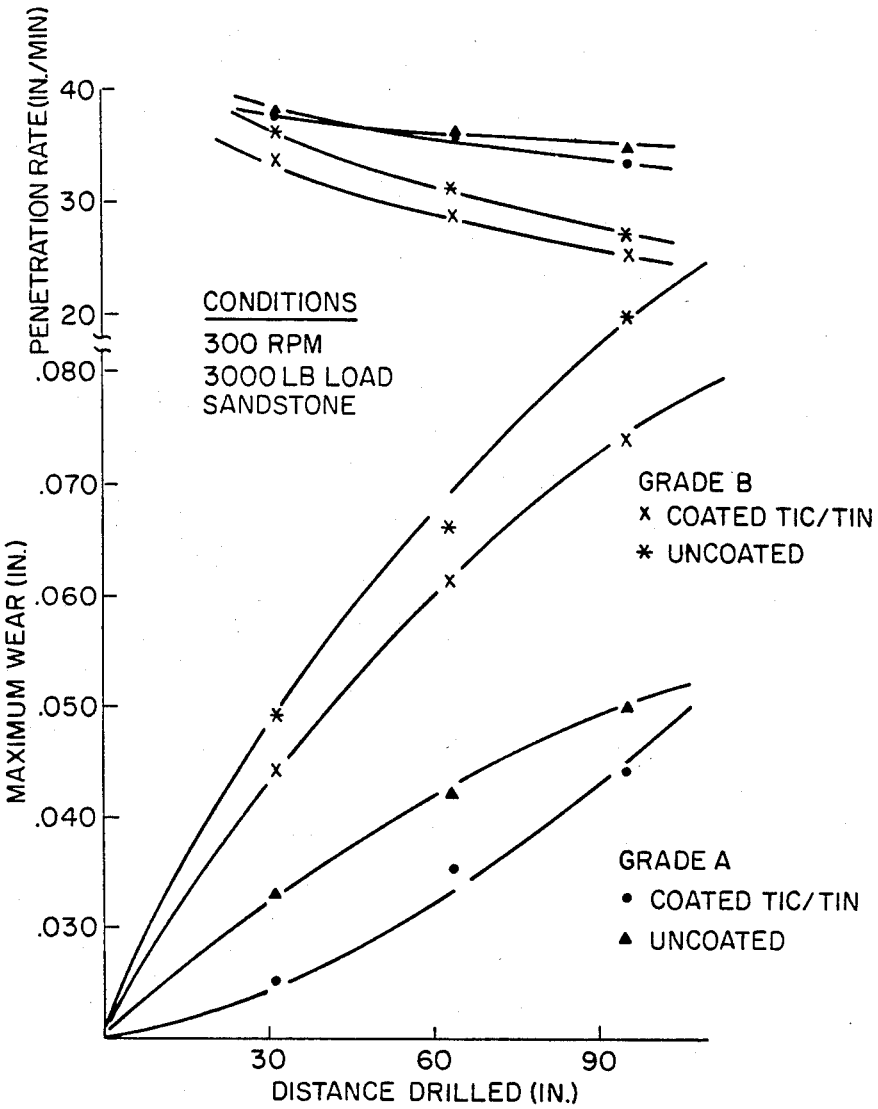
FIG. 4 is a graph illustrating the improvement in wear resistance and maintenance of penetration rate described in Example 2.

The test described in Example 1 was repeated, but with a drilling speed of 200 rpm. As may be seen in FIG. 4, the coating improved the wear resistance of samples of both insert A and insert B with good maintenance of the penetration rate.

EXAMPLE 3

Wear Resistance of TiC/TiN Coated Inserts in Concrete Medium

Figure 5:
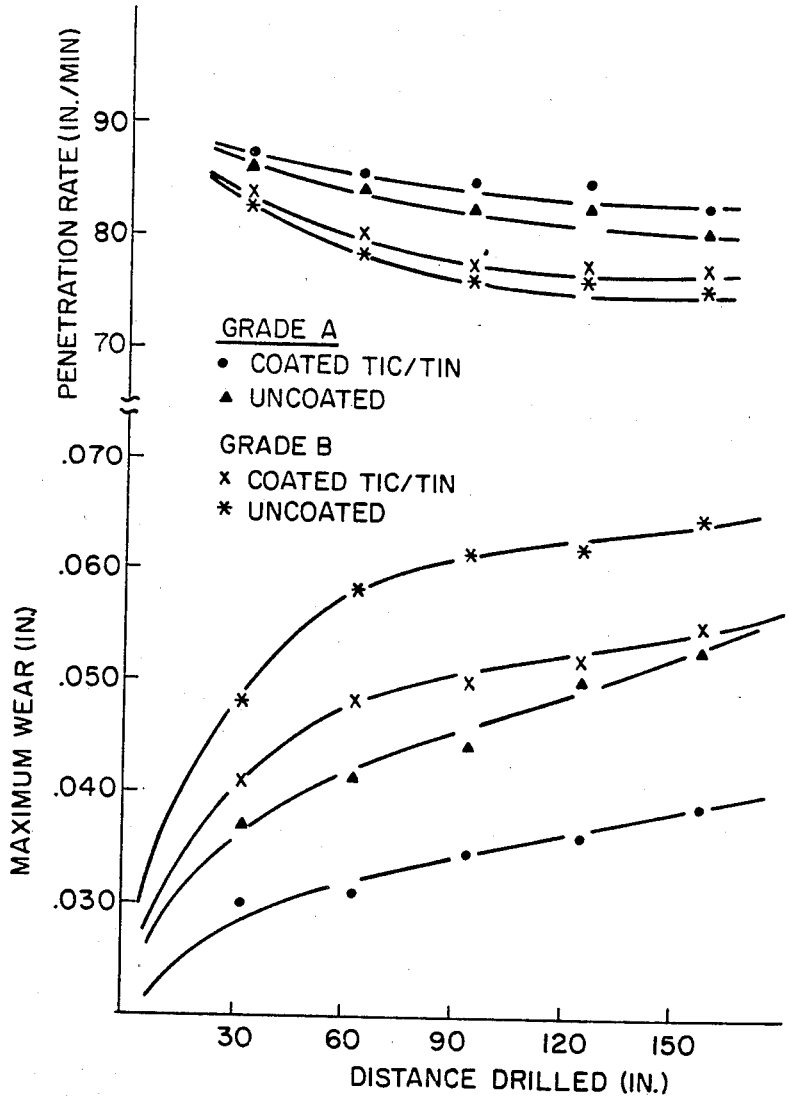
FIG. 5 is a graph illustrating the improvement in wear resistance and maintenance of penetration rate described in Example 3.

The test described in Example 1 was repeated, except that the drilling medium was concrete (2:1) and the drilling speed was set at 300 rpm. FIG. 5 illustrates the improvement in wear resistance when drilling concrete for both insert A and insert B samples achieved by applying the TiC/TiN coating described above, with good maintenance of the penetration rate.

EXAMPLE 4

Wear Resistance of TiC/$Al_2O_3$ Coated Inserts

Samples of insert A were coated by a chemical vapor deposition process with an adherent inner layer of titanium carbide and an adherent outer layer of $Al_2O_3$. The TiC layers were about 5 microns thick; the $Al_2O_3$ layers ranged from about 2 to about 4 microns thick.

Figure 6:
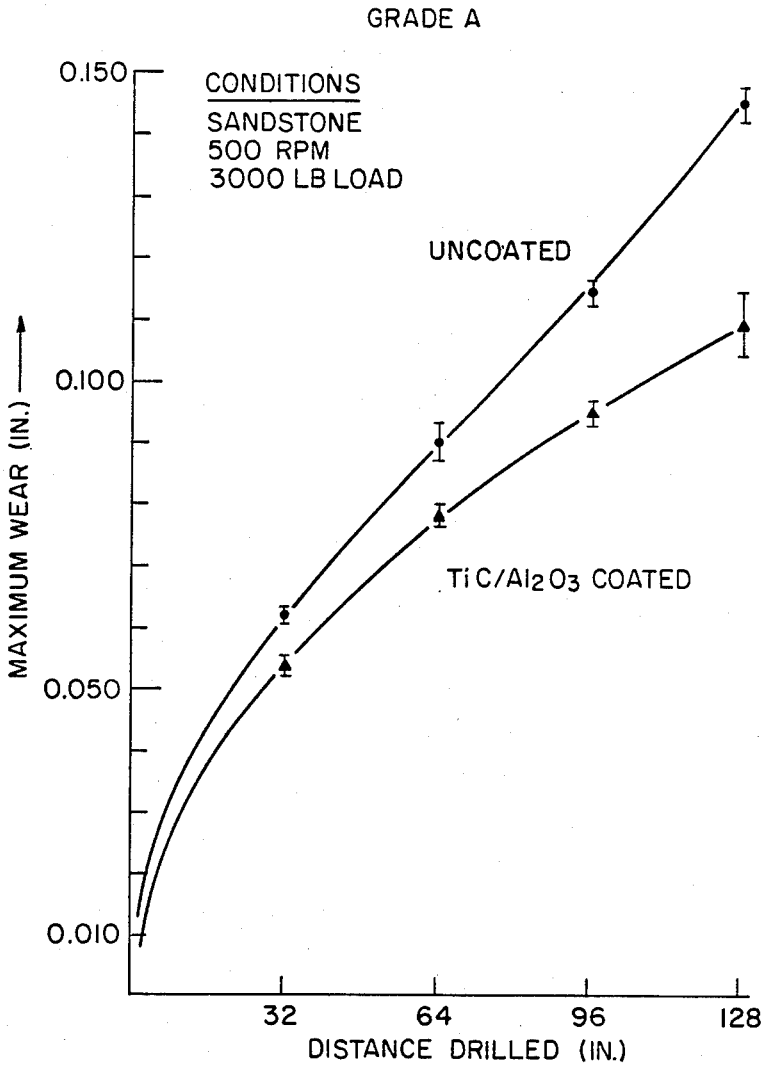
FIG. 6 is a graph illustrating the improvement in wear resistance described in Example 4.
Figure 7:
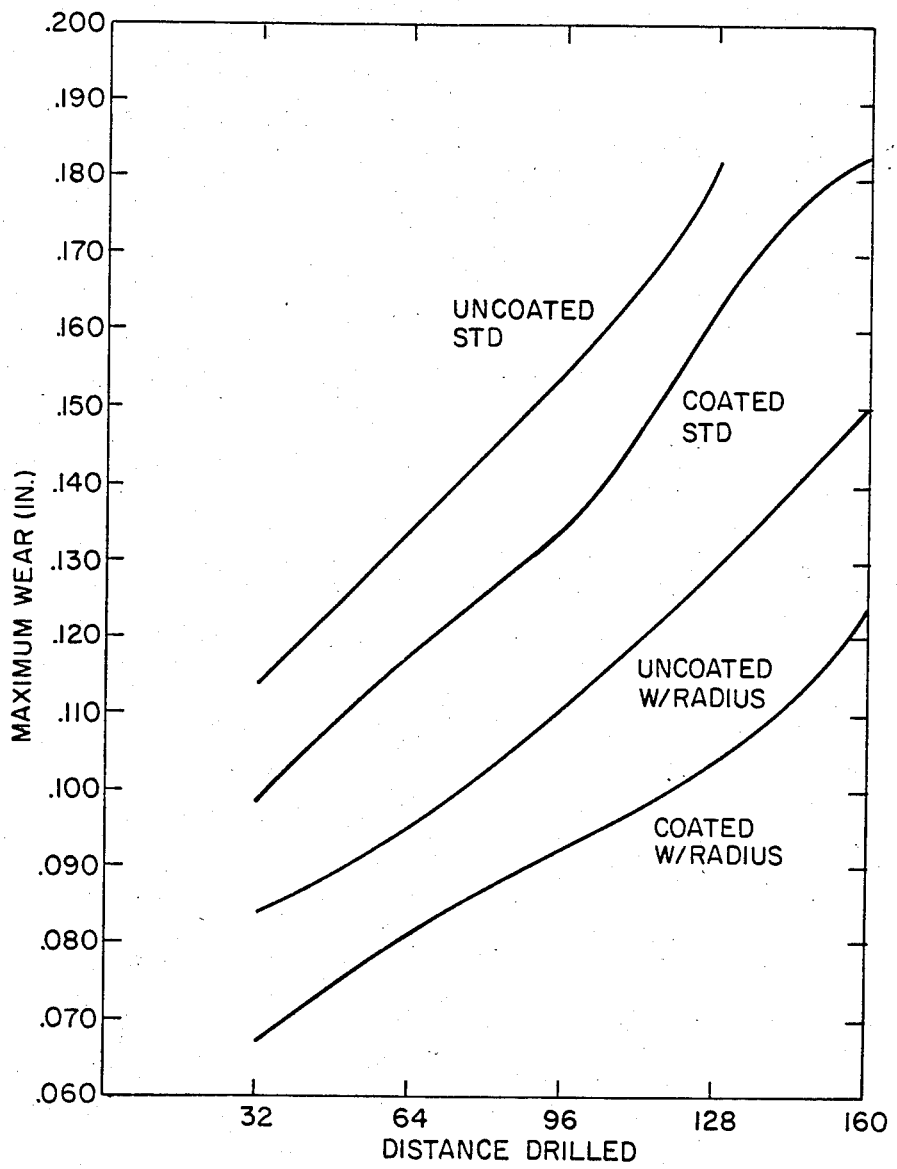
FIG. 7 is a graph illustrating the improvement in wear resistance described in Example 5.

Holes 32 inches in depth were drilled in sandstone using uncoated samples of insert A and the coated samples described above. The drilling speed was maintained at 500 rpm; the thrust at 3000 lbs. As illustrated in FIG. 6, the TiC/alumina coatings improved the wear resistance of the inserts.

EXAMPLE 5

The Effect of Insert Geometry on Improvement Achieved With TiC/$Al_2O_3$ Coated Inserts The test described in Example 1 was repeated, using insert samples of varying geometry, all having the composition of insert A. The coated and uncoated insert samples tested were inserts similar to that illustrated in FIG. 1 and radiused inserts similar to that illustrated in FIG. 2 and described above and in U.S. Pat. No. 4,489,796. The maximum (or gauge) diameters of the uncoated and coated samples were 1.375 inches. The radius of curvature of the radiused samples was 1/16 inch. The coated samples were coated with an adherent inner layer of titanium carbide about 5 microns thick and an adherent outer layer of $Al_2O_3$ about 2 to 4 microns thick. FIG. 8 illustrates the results of these tests. The wear resistance of both the coated radiused and the coated standard insert samples is higher than either type of uncoated sample, the coated radiused insert sample showing the highest wear resistance of those tested.

As illustrated by the above Examples, the present invention provides inserts having improved wear resistance during drilling of hard materials in a wide range of rotational speeds, thus increasing tool life. Further, the penetration rate provided by such improved inserts is well maintained. Accordingly, it may be seen that the novel methods and inserts of the present invention are a significant advance over known methods and inserts.

While there has been shown and described what are at present considered the preferred embodiments of the invention, it will be obvious to those skilled in the art that various changes and modifications can be made therein without departing from the scope of the invention as defined by the appended claims.

What is claimed is:

1. A method of drilling a hole in a hard material such as rock, coal, masonry, concrete, and the like comprising:

positioning a drilling tool having a drilling tool bit insert comprising a shaped substrate formed of a hard, fracture resistant material and coated with one or more thin adherent layers of refractory coating material, the material of each layer comprising a composition independently selected from the group consisting of carbides, nitrides, and carbonitrides of titanium, hafnium, vanadium, tantalum, and niobium, and oxides of aluminum and zirconium, and mixtures and solid solutions thereof;

rotating the drilling tool bit insert at a sufficient rate and applying sufficient thrust to the drilling tool bit insert to drill the hole in the hard material.

2. A method of drilling a hole in a mine roof according to claim 1 comprising:

positioning a mine tool having a mine tool roof bit insert comprising a shaped substrate formed of a hard, fracture resistant material and coated with one or more thin adherent layers of refractory coating material, the material of each layer comprising a composition independently selected from the group consisting of carbides, nitrides, and carbonitrides of titanium, hafnium, vanadium, tantalum, and niobium, and oxides of aluminum and zirconium, and mixtures and solid solutions thereof;

rotating the mine tool roof bit insert at a rate between about 100 rpm and about 1700 rpm; and applying a thrust to the mine tool roof bit insert of between about 500 lbs and about 8000 lbs to drill the hole in the mine roof.

3. A method according to claim 2 wherein the insert is rotated at a rate of aoout 500 rpm, and the thrust is about 3000 lbs.

4. A method according to claim 2 wherein the insert is rotated at a rate of about 200 rpm, and the thrust is about 3000 lbs.

5. A method of drilling a hole in concrete, masonry or the like according to claim 1 wherein the insert is rotated at a rate of about 100 to about 1700 rpm, and the thrust is about 100 to about 5000 lbs.

6. A mine tool roof bit insert comprising:

a shaped substrate formed of a hard, fracture resistant material and having one or more cutting edges; and one or more thin adherent layers of refractory coating material deposited on the substrate at least at and adjacent to the cutting edges, the material of each layer comprising a composition independently selected from the group consisting of carbides, nitrides, and carbonitrides of titanium, hafnium, vanadium, tantalum, and niobium, and oxides of aluminum and zirconium, and mixtures and solid solutions thereof.

7. An insert according to claim 6 wherein the material of the substrate comprises cemented tungsten carbide containing from about 5 w/o to about 15 w/o cobalt.

8. An insert according to claim 6 wherein one or more of the adherent layers of refractory coating material are each deposited by chemical or physical vapor deposition.

9. An insert according to claim 6 wherein the thickness of each of the one or more layers of refractory coating material is between about 0.5 microns and about 20 microns.

10. An insert according to claim 6 wherein the material of the substrate comprises cemented tungsten carbide containing about 6 w/o cobalt and the one or more adherent layers comprise an inner layer of titanium carbide and an outer layer of titanium nitride, the total thickness of the layers being between about 5 microns and about 10 microns.

11. An insert according to claim 6 wherein the material of the substrate comprises cemented tungsten carbide containing about 6 w/o cobalt and the one or more adherent layers comprise an inner layer of titanium carbide and an outer layer of $Al_2O_3$, the total thickness of the layers being between about 5 microns and about 10 microns.

12. An insert according to claim 6 wherein the refractory coating material is deposited on the entire surface of the substrate.

13. An insert accorcing to claim 6 wherein the substrate comprises a flat elongated member generally symmetrical about a central axis and having two generally planar side surfaces extending substantially parallel to the central axis; the perimeters of the side surfaces being interconnected by at least a bottom surface, two end surfaces and two top surfaces, each top surface joining one of the end surfaces to define a rounded corner; each rounded corner having a point located thereon, each point being positioned a maximum distance from the central axis measured along a line perpendicular to the central axis, the two maximum distances added together defining a maximum diameter for the substrate; and each rounded corner having a radius of curvature between about 0.023 and about 0.068 times the maximum diameter of the insert.

14. An insert according to claim 13 wherein the material of the substrate comprises cemented tungsten carbide containing about 6 w/o cobalt and the one or more adherent layers comprise an inner layer of titanium carbide and an outer layer of $Al_2O_3$, the total thickness of the layers being between about 5 microns and about 10 microns.

15. A masonry drill bit insert comprising:

a shaped substrate formed of a hard, fracture resistant material and having one or more cutting edges; and one or more thin adherent layers of refractory coating material deposited on the substrate at least at and adjacent to the cutting edges, the material of each layer comprising a composition independently selected from the group consisting of carbides, nitrides, and carbonitrides of titanium, hafnium, vanadium, tantalum, and niobium, and oxides of aluminum and zirconium, and mixtures and solid solutions thereof.

16. An insert according to claim 15 wherein the material of the substrate comprises cemented tungsten carbide containing from about 5 w/o to about 15 w/o cobalt.

17. An insert according to claim 15 wherein one or more of the adherent layers of refractory coating material are deposited by chemical or physical vapor deposition.

18. An insert according to claim 15 wherein the thickness of each of the one or more layers of rerractory coating material is between about 0.5 microns and about 20 microns.

19. An insert according to claim 15 wherein the refractory coating material is deposited on the entire surface of the substrate.

20. An insert according to claim 15 wherein the material of the substrate comprises cemented tungsten carbide containing about 6 w/o cobalt and the one or more adherent layers comprise an inner layer of titanium carbide and an outer layer of titanium nitride, the total thickness of the layers being between about 5 microns and about 10 microns.

21. An insert according to claim 15 wherein the material of the substrate comprises cemented tungsten carbide containing about 6 w/o cobalt and the one or more adherent layers comprise an inner layer of titanium carbide and an outer layer of $Al_2O_3$, the total thickness of the layers being between about 5 microns and about 10 microns.

22. An insert according to claim 15 wherein the substrate comprises a flat elongated member generally symmetrical about a central axis and having two generally planar side surfaces extending substantially parallel to the central axis; the perimeters of the side surfaces being interconnected by at least a bottom surface, two end surfaces and two top surfaces, each top surface joining one of the end surfaces to define a rounded corner; each rounded corner having a point located thereon, each point being positioned at a maximum distance from the central axis measured along a line perpendicular to the central axis, the two maximum distances added together defining a maximum diameter for the substrate; and each rounded corner having a radius of curvature between about 0.023 and about 0.068 times the maximum diameter of the insert.

* * * * *